US005893465A

United States Patent [19]

Harangozo

[11] Patent Number: 5,893,465

[45] Date of Patent: Apr. 13, 1999

[54] FOOD PRODUCT SORTER

[75] Inventor: Sebastian M. Harangozo, Stayton, Oreg.

[73] Assignee: Welliver Metal Products Corporation, Salem, Oreg.

[21] Appl. No.: 09/105,600

[22] Filed: Jun. 26, 1998

[51] Int. Cl.[6] ..... B07B 13/05

[52] U.S. Cl. ..... 209/674; 209/678; 209/679

[58] Field of Search ..... 209/665, 667, 209/675, 677, 678, 679, 674

[56] References Cited

U.S. PATENT DOCUMENTS

| | | | |
|---|---|---|---|
| 425,705 | 4/1890 | Smallwood . | |
| 431,176 | 7/1890 | Thissell . | |
| 482,294 | 9/1892 | Burke | 209/679 X |
| 497,599 | 5/1893 | Pease . | |
| 932,745 | 8/1909 | Barnett . | |
| 1,190,067 | 4/1916 | Zenge . | |
| 2,295,190 | 9/1942 | Zenge et al. . | |
| 2,728,455 | 12/1955 | Greiner . | |
| 2,908,389 | 10/1959 | Lauer . | |
| 3,347,368 | 10/1967 | Mogensen . | |
| 4,696,738 | 9/1987 | Risley . | |

FOREIGN PATENT DOCUMENTS

| | | |
|---|---|---|
| 74 610 | 7/1970 | Germany . |
| 35 09 079 | 2/1986 | Germany . |
| 406125760 | 5/1994 | Japan . |
| 29993 | 1/1933 | Netherlands . |
| 8303058 | 4/1985 | Netherlands . |
| 272179 | 6/1967 | Russian Federation . |
| 510279 | 7/1939 | United Kingdom . |
| 2 233 256 | 1/1991 | United Kingdom . |

*Primary Examiner*—Boris Milef
*Assistant Examiner*—Gene D Crawford
*Attorney, Agent, or Firm*—Kolisch Hartwell Dickinson McCormack & Heuser

[57] ABSTRACT

An apparatus for sorting fragile objects has a grading structure connected to a base. The grading structure is movable in first and second substantially horizontal directions with respect to the base. A displacement mechanism imparts reciprocating, substantially horizontal movement of predetermined frequency and amplitude to at least part of the grading structure to thereby move the objects in the first substantially horizontal direction along the grading structure. A displacement controller variably controls the frequency and amplitude of the reciprocating horizontal movement. The frequency of movement in the first substantially horizontal direction is controlled independently of the frequency of movement in the second substantially horizontal direction.

27 Claims, 5 Drawing Sheets

FOOD PRODUCT SORTER

FIELD OF THE INVENTION

The present invention relates to a device for sorting delicate or fragile items, such as food products, by size.

BACKGROUND OF THE INVENTION

An important factor in marketing and purchasing produce is uniformity in size and quality. Food producers typically find it more economical to pack and ship a uniform grade of produce, and consumers expect a certain grade of produce for a given price. To accomplish the grading operation, a food crop is typically sorted by size after the crop is harvested. Automation of this process has been somewhat successful, as many machines have been developed to grade fruits and vegetables by size. One particular machine design shakes the produce along sloped diverging rods. When the distance between the rods exceeds the size of the produce, the produce falls between the rods. The distance the produce travels along the rods before falling indicates the size of the produce. Sorting machines of this type are preferred because of the simplicity of the design.

However, such sorting machines have several limitations. Sloped rods may cause the produce to roll along the rods and bruise adjacent produce. If the rods are horizontal, a vertical component has been added to the movement of the rods so that the produce will move along the diverging rods. This is also undesirable because vertical shaking can also cause bruising. In addition, known graders shake the produce by employing a rotating eccentric shaft or cam mechanism to impart periodic oscillation to the rods. Since the amplitude and acceleration of the oscillatory motion are functions of the shape of the eccentric or cam, the only way to vary the shaking motion of the produce is to vary the speed of the periodic oscillation. Too low of a speed limits the amount of produce that can be sorted by the grader in a given time, and too high of a speed risks damaging the produce.

SUMMARY OF THE INVENTION

The present invention overcomes these problems by providing an apparatus for sorting fragile objects, the apparatus having a grading structure connected to a base and movable in first and second substantially horizontal directions with respect to the base. A displacement mechanism imparts reciprocating, substantially horizontal movement of predetermined frequency and amplitude to at least part of the grading structure to thereby move the objects in the first substantially horizontal direction along the grading structure. A displacement controller variably controls the frequency and amplitude of the reciprocating horizontal movement. The frequency of movement in the first substantially horizontal direction is controlled independently of the frequency of movement in the second substantially horizontal direction.

Another aspect of the present invention is an apparatus for sorting fragile objects, the apparatus including a grading structure with a plurality of non-intersecting bars disposed in a horizontal plane, the bars arranged so that a gap is created between adjacent bars. The size of the gap increases as the bars extend in the first substantially horizontal direction. A displacement mechanism moves objects to be sorted along the bars by maintaining non-slipping contact between the objects and the bars when moving the bars in the first horizontal direction, and initiating slipping contact between the objects and the bars when moving the grading structure in a second horizontal direction opposite the first horizontal direction. The objects thereby maintain contact with the bars until the size of the gap is larger than a width of one of the objects. The object width is measured in a direction normal to the first horizontal direction. A displacement controller variably controls the frequency and amplitude of the reciprocating horizontal movement.

Still another aspect of the invention includes an apparatus for sorting fragile objects, the apparatus having a counterbalance mechanism resiliently connected to a base. A grading structure is movable substantially horizontally with respect to the base and includes a plurality of non-intersecting bars disposed in a substantially horizontal plane. The bars are arranged to form a unitary bar assembly movably connected to the counterbalance mechanism such that the bar assembly is movable in a first substantially horizontal direction and a second substantially horizontal direction opposite the first substantially horizontal direction. A displacement mechanism imparts reciprocating, substantially horizontal movement of predetermined frequency and amplitude to the bar assembly so that the objects to be sorted move in the first substantially horizontal direction along the bar assembly.

DETAILED DESCRIPTION OF THE PREFERRED EMBODIMENT

Figure 1:
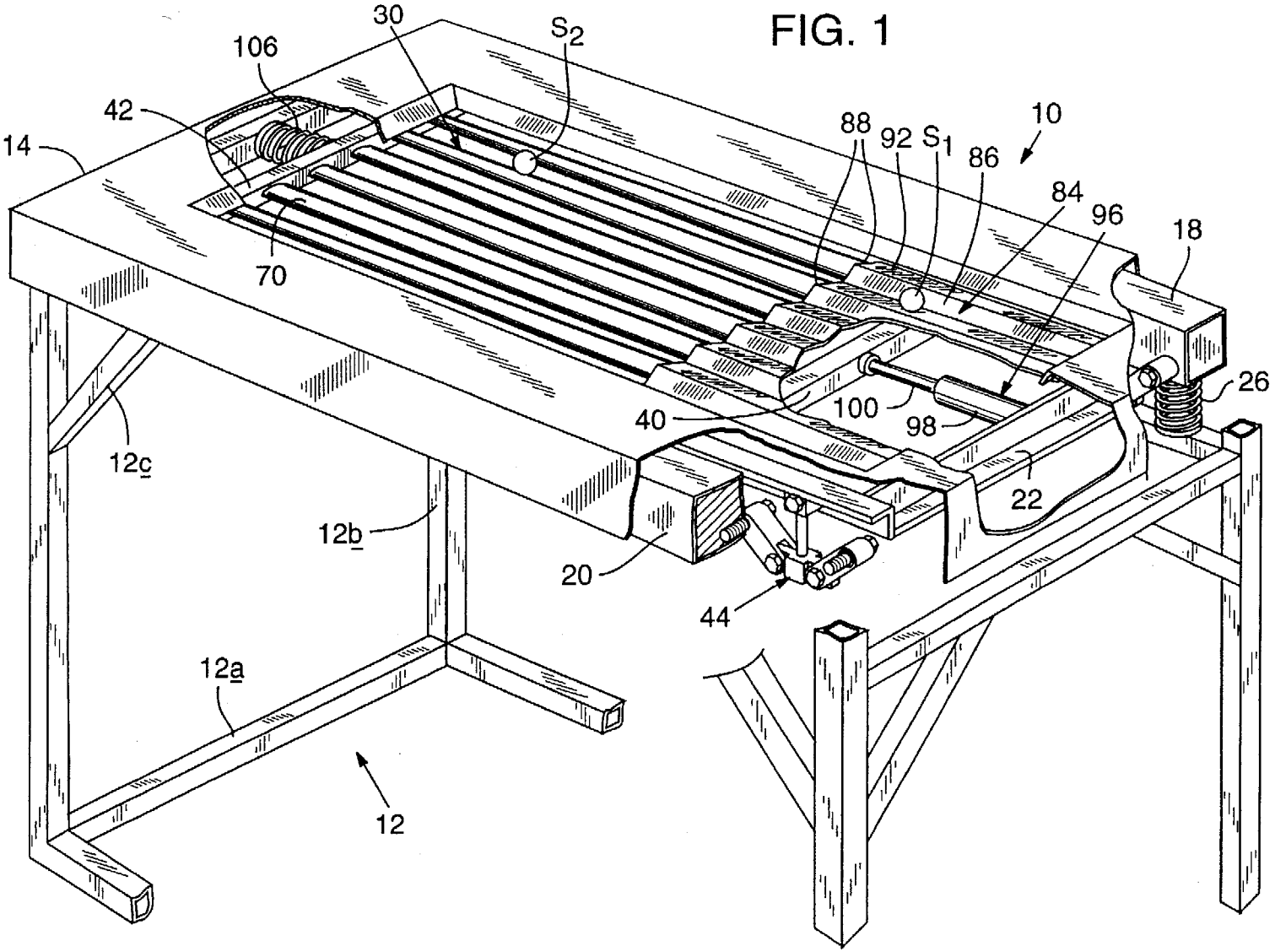
FIG. 1 is an isometric view of the sorter of the present invention.

FIGS. 1–4 show a sorter 10 for sorting fruits, vegetables, or other fragile or delicate objects according to the present invention. Sorter 10 has a base 12 that is designed to support all the components of the sorter such that the sorter is substantially self-contained. Base 12 can include a plurality of interconnected horizontal, vertical, and diagonal struts 12*a*, 12*b*, 22*c*. Attached to the base is a removable top cover 14.

Base 12 further includes a counterbalance mechanism 16 with two substantially parallel counterbalances 18, 20 connected by crossbars 22, 24 to form a rectangular construction. Counterbalances 18, 20 can be hollow and filled with sand or cement, or can alternately have a solid construction. Counterbalance mechanism 16 is connected to the remainder of base 12 via vertical compression springs 26, which rest on and are attached to the four corners of the base.

Figure 4:
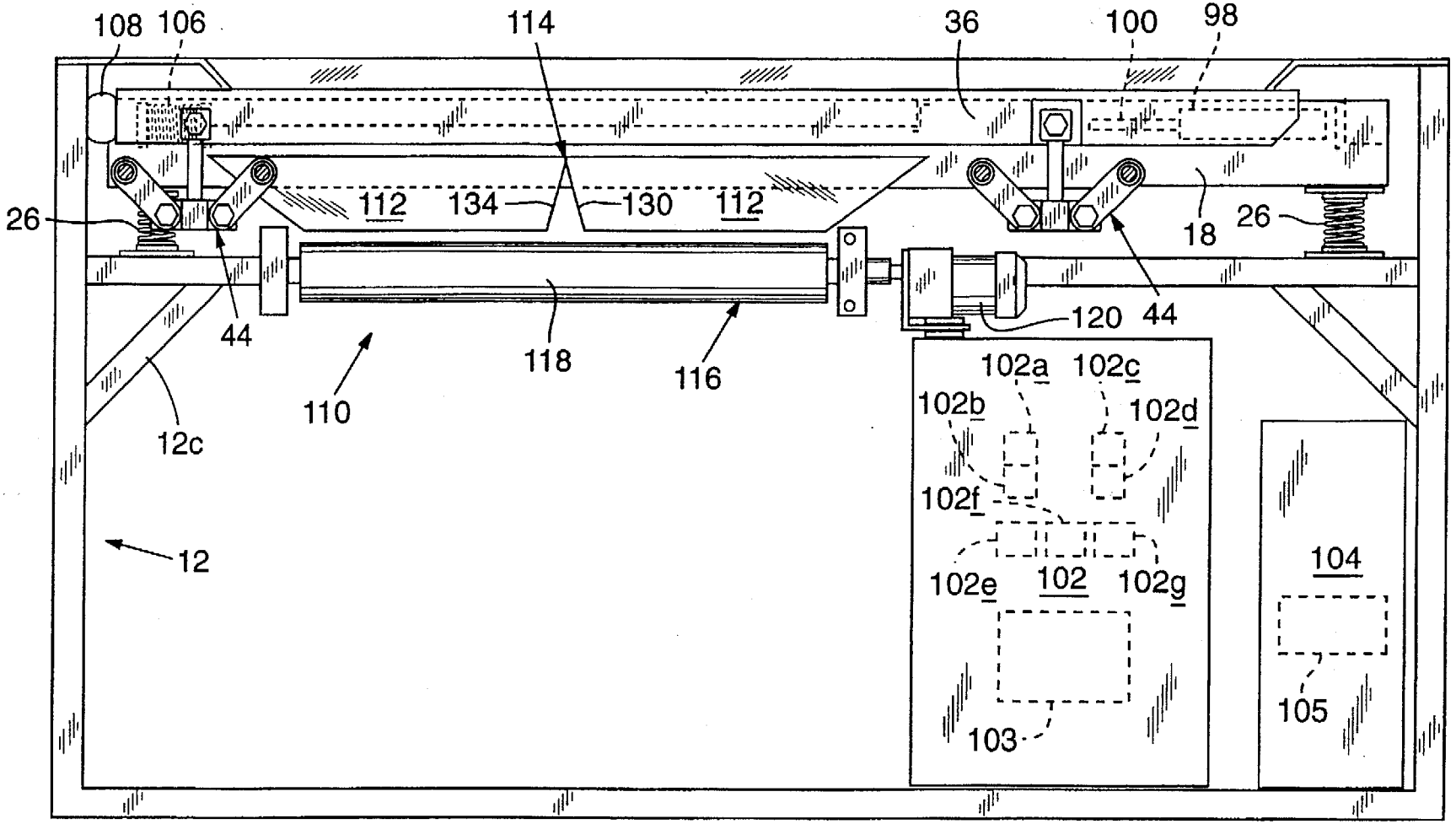
FIG. 4 is a side elevation sectional view taken through line 4—4 in FIG. 2.
Figure 5:
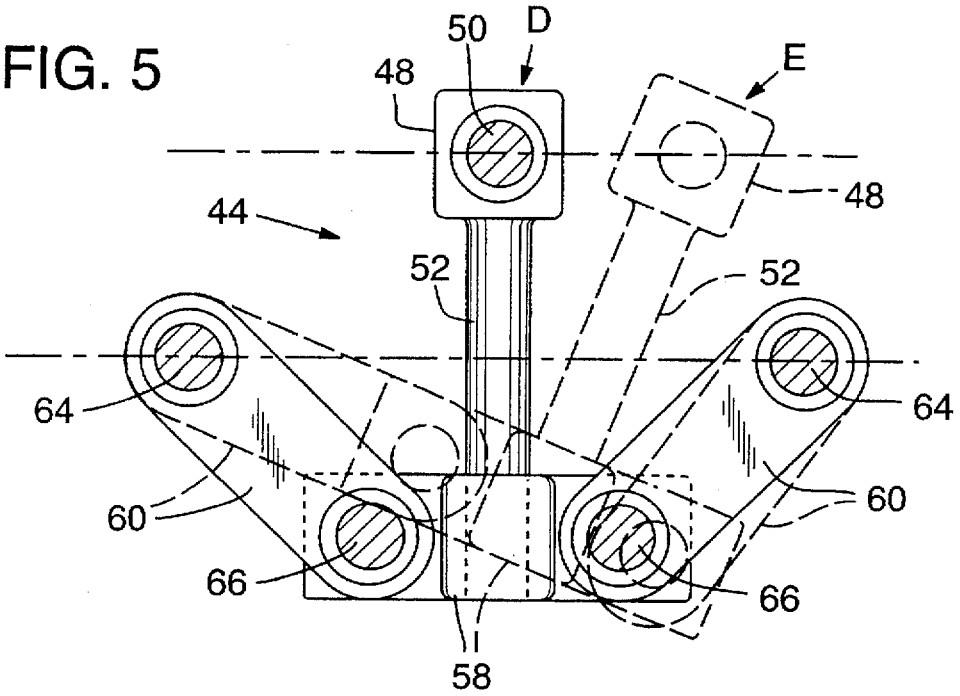
FIG. 5 is a detailed, side elevation view of a linkage used with the sorter of FIG. 1.
Figure 6:
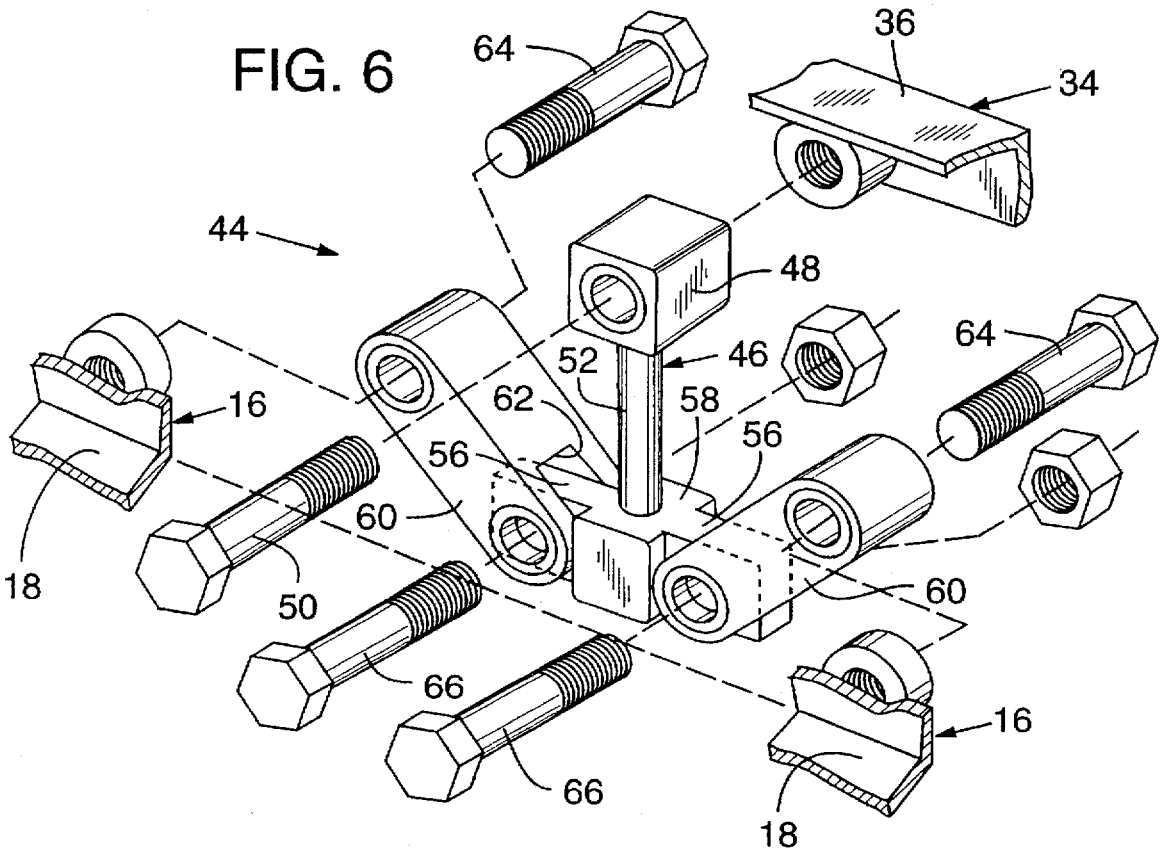
FIG. 6 is an isometric, exploded view of the linkage shown in FIG. 5.

Sorter 10 includes a grading structure, indicated generally at 30. Grading structure 30 includes a bar assembly 32 having a frame 34. Frame 34 has two longitudinal members 36, 38 that are generally parallel to counterbalances 18, 20. Crossbars 40, 42 connect longitudinal members 36, 38. In the depicted embodiment, four linkages, indicated generally at 44, connect frame 34 to counterbalance mechanism 16. As shown in FIGS. 4–6, each linkage 44 includes a connector 46 having an upper portion 48 rotationally connected by a bolt 50 to frame 34. A rod 52 extends vertically downward to connect to a lower portion 54. Distal ends 56 of lower portion 54 have a reduced width with respect to the central area 58 of the lower portion. Upper portion 48, rod 52, and lower portion 54 form a rigid assembly. Each of first and second links 60 has a slot 62 for accepting a distal end 56 of lower portion 54. Bolts 64 rotatably connect each link to a respective distal end 54. Bolts 66 rotatably connect each link 60 to counterbalance mechanism 16 at an end of the link opposite slot 62. As shown in FIG. 5, relative horizontal movement between counterbalance mechanism 16 and bar assembly 32 causes connector 46 and links 60 to rotate from an initial position D to a second position E. Upper portion 48 rotates and moves horizontally but in the depicted embodiment does not move vertically. Similarly, bolts 66, representing the connection point between linkages 44 and counterbalance mechanism 16, do not move vertically. As depicted, linkages 44 thereby prevent relative vertical movement between counterbalance mechanism 16 and bar assembly 32 while allowing relative horizontal movement therebetween.

Figure 2:
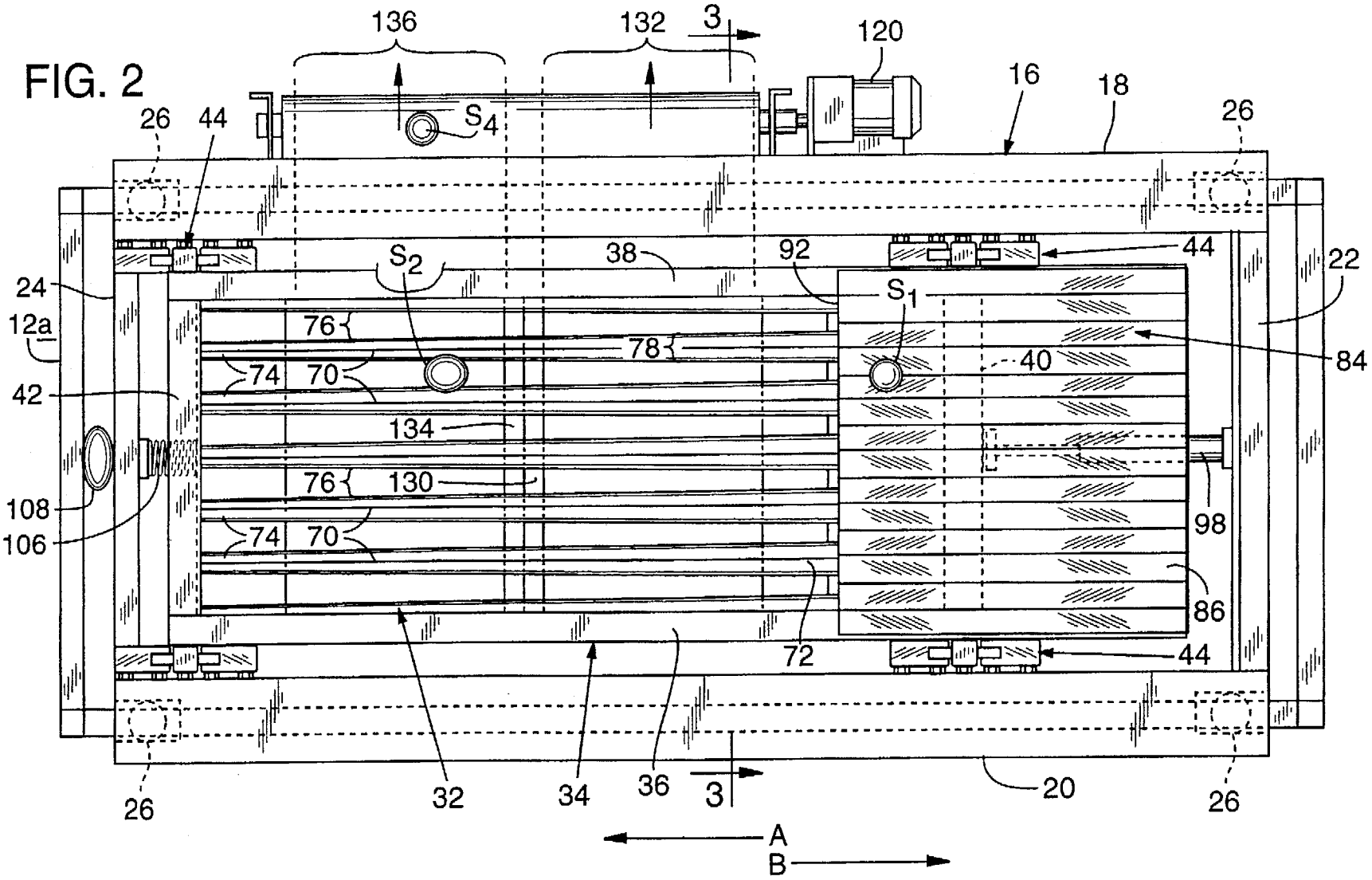
FIG. 2 is a top view of the sorter shown in FIG. 1.
Figure 3:
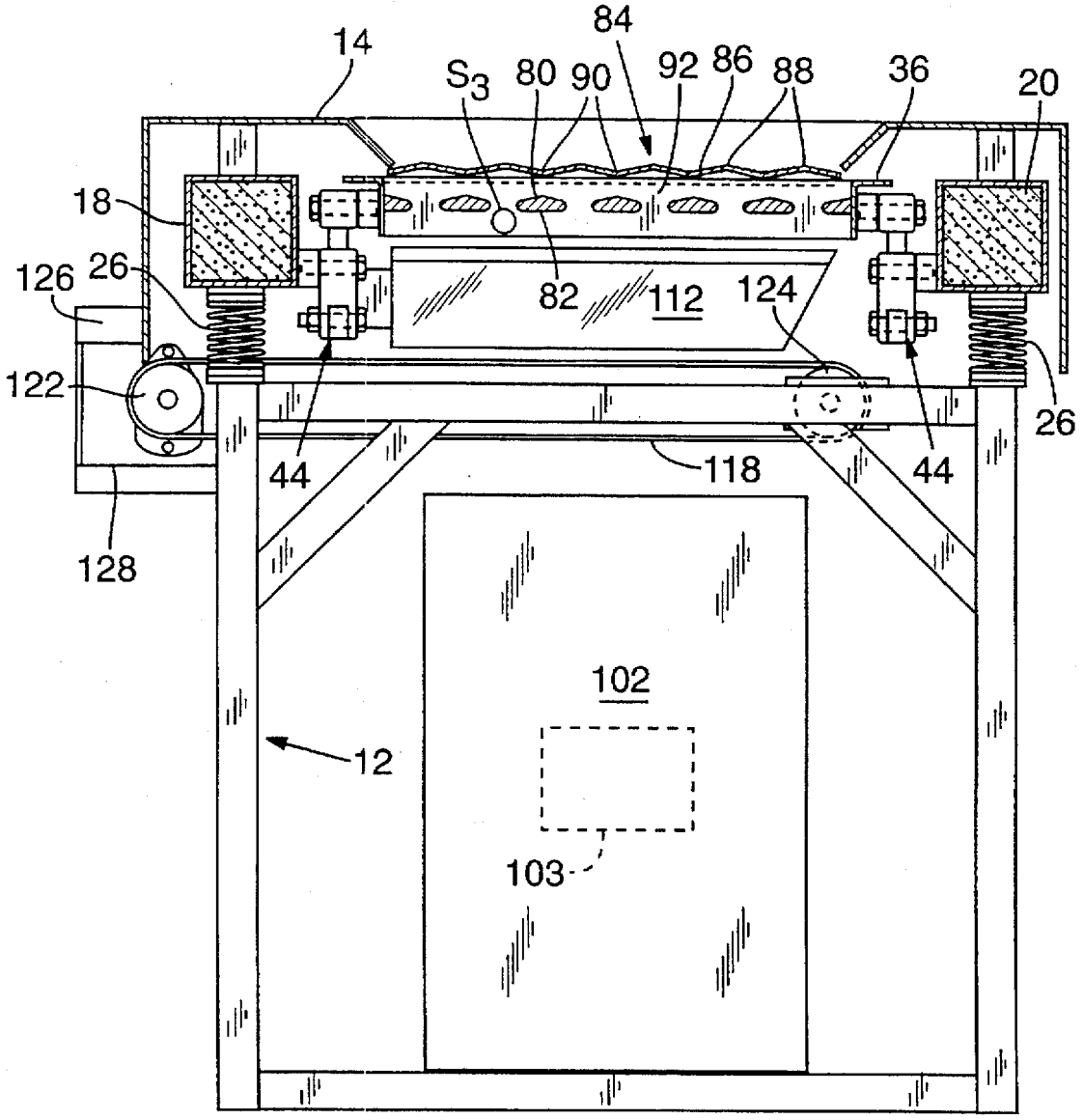
FIG. 3 is an end elevation sectional view taken through line 3—3 in FIG. 2, showing a preferred cross-sectional shape of the bars.

Bar assembly 32 also includes a plurality of non-intersecting, substantially horizontal bars 70 attached to frame 34. Bars 70 are disposed along the length of sorter 10 in a substantially horizontal plane. Each of the bars 70 has a first end 72 and a second end 74. Bars 70 are arranged so that a gap 76 exists between adjacent bars. As best shown in FIG. 2, the size of gaps 76 increase in a first substantially horizontal direction A. In the preferred embodiment, the increasing gap size is created by arranging bars 70 parallel to each other and by continuously decreasing, or tapering, the width 78 of the bars between first and second ends 72, 74. As shown in FIG. 3, in a preferred embodiment each of bars 70 has a peaked side 80 and a flat side 82 that define a generally triangular cross-section. Peaked side 80 faces upward so that peaked sides of adjacent bars 70 contact objects during sorting. Alternatively, bars 70 can have a rounded upper side (FIG. 1). Bars 70 can be adjusted so that the distance between first ends of adjacent bars is increased or decreased to accommodate different sizes and types of objects.

An alignment mechanism, such as a pre-sorter 84, is attached to bar assembly 32 (FIGS. 1 and 3). In the depicted embodiment, pre-sorter 84 is a sheet of substantially horizontal material 86 having a plurality of ridges 88 and depressions 90. An edge 92 of sheet 86 is substantially adjacent to first ends 72 of bars 70. As best seen in FIG. 3, ridges 88 are aligned with gaps 76 between bars 70. Pre-sorter 84 is preferably designed to move with bar assembly 32.

A fluid-driven displacement mechanism, indicated generally at 96 in FIG. 1, is positioned to move bar assembly 32 substantially horizontally. In the preferred embodiment, displacement mechanism 96 includes a hydraulic cylinder having a piston housing 98 secured to crossbar 22 of counterbalance mechanism 16. An arm 100 extends from piston housing 98 and hydraulically reciprocates with respect to piston housing 98. Arm 100 is secured to crossbar 40 of bar assembly 32. Hydraulic cylinder 96 is designed to impart a reciprocating horizontal motion to bar assembly 32, which includes pre-sorter 84, with respect to base 12. A displacement controller, shown in FIGS. 3–4 as hydraulic control unit 102, includes a proportional solenoid 103 that preferably controls the displacement, velocity, and acceleration of hydraulic cylinder 96. Hydraulic control unit 102 includes first velocity and acceleration controls **102*a*, 102*b* for variably controlling velocity and acceleration, respectively, of bar assembly 32 in the first substantially horizontal direction. Hydraulic control unit 102 also includes second velocity and acceleration controls 102*c*, 102*d* for variably controlling, independent of the first velocity and acceleration controls 102*a–b*, velocity and acceleration, respectively, of bar assembly 32 in the second substantially horizontal direction. A displacement control 102*e* is also included in the hydraulic control unit so that the amplitude of the reciprocating movement of bar assembly 32 can be variably controlled. The frequency of movement in the first and second substantially horizontal directions is a function of at least one of velocity, acceleration, and displacement. The user can therefore variably control the frequency of movement of bar assembly 32 using controls 102*a–d*. A frequency control 102*f* can optionally be provided that combines the first and second velocity and acceleration controls 102*a–d*. A memory unit 102*g* can also be provided that stores the settings of controls 102*a–f* for different types of objects to be sorted. Controls 102*a–g* and solenoid 103 can be connected in any known fashion. A user preferably operates hydraulic control unit 102 by user input devices 105 found on a control panel 104 (FIG. 4). User input devices 105 can include knobs, dials, switches, slides, keypad, digital interfaces, or other known devices. The user can thereby variably adjust the frequency, amplitude, velocity, and acceleration the movement of bar assembly 32. A horizontal compression spring 106 is positioned between crossbar 24 of counterbalance mechanism 16 and crossbar 42 of bar assembly 32. Horizontal compression spring 106 counteracts the movement of hydraulic cylinder 96 to dampen the resulting reciprocating movement of the bar assembly with respect to the counterbalance mechanism. A dampening mechanism, such as a shock absorber or airbag 108 (FIG. 2), may be positioned between crossbar of counterbalance mechanism and a horizontal strut 12*a* to isolate horizontal movement of counterbalance mechanism 16 with respect to the remainder of base 12**.

An object removal mechanism 110 (FIGS. 2–4) is positioned below bar assembly 32 and is operative to remove objects S from sorter 10 after the objects have been graded by the bar assembly. Object removal mechanism 110 includes a chute 112 that has at least one baffle 114 designed to separate graded objects $S_3$ and maintain the graded objects in a graded condition. Baffle 114 can typically be adjusted in substantially horizontal directions A and B to variably define the graded condition of objects $S_3$. Chute 112 directs the graded objects in a generally downward direction to a conveyor assembly 116 that laterally transports the graded objects out of grader 10 as shown by $S_4$. Conveyor assembly 116 is shown in the Figures as having a single belt 118 driven by an electric motor 120 and moving between two rollers 122, 124. A removable head roll cover 126 shields roller 122 and has an open bottom 128 through which the graded objects $S_4$ drop to be further processed. Conveyor assembly 116 can also include independent belts, possibly moving in different directions. If grader is to be used with fragile objects such as tomatoes or raspberries, a known water-channel type conveyor could also be used.

In operation, a user places an unsorted object $S_1$, having a nominal width, on pre-sorter 84. Gravity tends to move unsorted object $S_1$ into one of the depressions 90. When hydraulic cylinder 96 is activated, pre-sorter 84 is moved in a first substantially horizontal direction A, the hydraulic control unit 102 controlling the velocity, acceleration, amplitude, and frequency of the movement of hydraulic cylinder 96 such that object $S_1$ maintains non-slipping contact with pre-sorter 84. Hydraulic control unit 102 also moves pre-sorter 84 in a second substantially horizontal direction B, which is opposite first substantially horizontal direction A, the hydraulic control unit 102 controlling the velocity, acceleration, amplitude, and frequency of the movement of hydraulic cylinder 96 such that object $S_1$ maintains slipping contact with pre-sorter 84. Ideally, object $S_1$ does not move in second substantially horizontal direction B. Velocity and acceleration control in first substantially horizontal direction A is independent of velocity and acceleration control in second substantially horizontal direction B. The repeated movement of hydraulic cylinder 96 in the first and second substantially horizontal directions A and B moves the object along pre-sorter 84 in first substantially horizontal direction A while maintaining contact with pre-sorter.

Object $S_1$ is moved in the fashion described above along pre-sorter 84 until the object reaches edge 92. The object contacts first ends 72 of bars 70 and is generally positioned in gap 76 such that peaked sides 80 of adjacent bars contact the object, shown in position $S_2$. The motion imparted by hydraulic cylinder 96 as described above moves object $S_2$ in first substantially horizontally direction A along bars 70 until the size of gap 76 is greater than the nominal width of the object. The nominal width is a width of the object measured horizontally and normal to the first and second substantially horizontal directions. The object then falls through gap 76 as shown at $S_3$. If the graded object falls through gap 76 on a first side 130 of baffle 114 (FIG. 2), chute 112 and baffle 114 direct the object to a first region 132 on belt 118 representing a first graded condition. If the graded object falls through gap 76 on a second side 134 of baffle a 114, chute a 112 and baffle 114 direct the object $S_4$ to a second region 136 on belt 118 representing a second graded condition. Conveyor assembly 116 then removes the graded object from sorter 10. Although the operation of sorter 10 has been described as grading a single object, the multiple bars 70 in the preferred embodiment allow sorter 10 to handle a constant flow of a plurality of objects. Objects can be positioned at multiple positions along bars 70 as the objects are moved by hydraulic cylinder 96 in first substantially horizontal direction A.

One advantage of the present invention is that the substantially horizontal movement imparted by displacement mechanism 96 is gentler on the objects than a movement with a vertical component. Because the objects slide along bar assembly instead of being shaken, bruising of fragile produce such as tomatoes, pears, or berries is significantly reduced.

Another advantage is that counterbalance mechanism 16 isolates the movement of bar assembly 32 from the base. This stabilizes sorter 10 and increases the working life of the sorter.

Another advantage of the present invention is that hydraulic cylinder 96 can be controlled in a directionally-independent manner to vary the displacement, velocity, acceleration, and frequency of the movement of grading structure 30 with respect to base 12. This allows grader to be used with a variety of fruit. In addition, the movement of sorter 10 can be easily adjusted during operation if a different movement is desired.

Yet another advantage of the present invention is that linkages 44 maintain the relative vertical positioning of counterbalance mechanism 16 with respect to bar assembly 32 while allowing relative horizontal movement therebetween. This further prevents bouncing of the produce and reduces bruising.

While the invention has been disclosed in its preferred form, it is to be understood that the specific embodiment thereof as disclosed and illustrated herein is not to be considered in a limited sense and changes or modifications may be made thereto without departing from the spirit of the invention.

I claim:

1. An apparatus for sorting fragile objects, the apparatus comprising:

a base;

a grading structure connected to the base and movable in a first substantially horizontal direction with respect to the base and a second substantially horizontal direction opposite the first substantially horizontal direction;

a displacement mechanism for imparting reciprocating movement in the first and second substantially horizontal directions of predetermined frequency and amplitude to the grading structure to thereby move the objects in the first substantially horizontal direction along the grading structure; and a displacement controller for variably controlling the frequency and amplitude of the reciprocating horizontal movement wherein the frequency of movement in the first substantially horizontal direction is controlled independent of the frequency of movement in the second substantially horizontal direction.

2. The apparatus of claim 1, wherein the displacement mechanism includes a hydraulic cylinder, the hydraulic cylinder moving the grading structure in the first and second substantially horizontal directions.

3. The apparatus of claim 1, wherein the displacement controller includes first and second velocity controls for selectively varying the velocity in which the displacement mechanism moves the grading structure in the first and second substantially horizontal directions, respectively, and wherein the first velocity control is independent of the second velocity control.

4. The apparatus of claim 1, wherein the displacement controller further includes first and second acceleration controls for selectively varying the acceleration imparted by the displacement mechanism to the grading structure in the first and second substantially horizontal directions, respectively, and wherein the first acceleration control is independent of the second acceleration control.

5. The apparatus of claim 1, wherein the grading structure includes a plurality of non-intersecting bars disposed in a substantially horizontal plane and generally oriented in the first substantially horizontal direction, the bars arranged so that a gap is created between adjacent bars, and wherein the size of the gap increases as the bars extend in the first substantially horizontal direction.

6. An apparatus for sorting fragile objects, the apparatus comprising:

a base;

a grading structure connected to the base and movable substantially horizontally with respect to the base, the grading structure including a plurality of non-intersecting bars disposed in a horizontal plane, the bars arranged so that a gap is created between adjacent bars, wherein the size of the gap increases as the bars extend in a first substantially horizontal direction;

a displacement mechanism for imparting reciprocating, substantially horizontal movement of predetermined frequency and amplitude to the bars to thereby move the objects in the first substantially horizontal direction along the grading structure, wherein the displacement mechanism moves the objects along the bars by maintaining non-slipping contact between the objects and the bars when moving the bars in the first substantially horizontal direction, and initiating slipping contact between the objects and the bars when moving the grading structure in a second substantially horizontal direction opposite the first substantially horizontal direction, the objects thereby maintaining contact with the bars until the size of the gap is larger than a width of one of the objects, wherein the object width is measured in a direction normal to the first substantially horizontal direction; and a displacement controller for variably controlling the frequency and amplitude of the reciprocating horizontal movement.

7. The apparatus of claim 6, wherein the displacement mechanism includes a hydraulic cylinder.

8. The apparatus of claim 7, wherein the grading structure further includes a counterbalance mechanism movably connected to the base, the plurality of bars movably connected to the counterbalance mechanism, wherein the hydraulic cylinder is operationally disposed between the bars and the counterbalance mechanism.

9. An apparatus for sorting fragile objects, the apparatus comprising:

a base;

a counterbalance mechanism resiliently connected to the base;

a grading structure movable substantially horizontally with respect to the base and including a plurality of non-intersecting bars disposed in a substantially horizontal plane, wherein the bars are arranged to form a unitary bar assembly movably connected to the counterbalance mechanism such that the bar assembly is movable in a first substantially horizontal direction with respect to the base and a second substantially horizontal direction opposite the first substantially horizontal direction; and a displacement mechanism for imparting reciprocating, substantially horizontal movement of predetermined frequency and amplitude to the bar assembly to thereby move the objects in the first substantially horizontal direction along the bar assembly.

10. The apparatus of claim 9, wherein the apparatus is a self-contained unit.

11. The apparatus of claim 9, further comprising a separating structure positioned to maintain the objects in a graded condition as the objects are displaced from the grading structure.

12. The apparatus of claim 9, further comprising an object removal mechanism for removing the objects from the apparatus after the objects have been graded by the grading structure.

13. The apparatus of claim 12, wherein the object removal mechanism comprises at least one conveyor.

14. The apparatus of claim 13, wherein the conveyor is positioned such that the conveyor removes the objects from the apparatus after the objects have been vertically displaced from the grading structure.

15. The apparatus of claim 14, further comprising a separating structure positioned between the grading structure and the conveyor, the separating structure operative to maintain the objects in a graded condition as the objects are displaced from the grading structure.

16. The apparatus of claim 15, wherein the separating structure can be adjusted such that the graded condition of the objects is varied.

17. The apparatus of claim 9, wherein the bars are arranged so that a gap is created between adjacent bars, and wherein the size of the gap increases as the bars extend in the first substantially horizontal direction.

18. The apparatus of claim 17, wherein the plurality of bars are arranged parallel to each other within the substantially horizontal plane.

19. The apparatus of claim 18, wherein each of the bars has a tapering width that decreases in the first substantially horizontal direction, thereby causing the size of the gap to increase in the first substantially horizontal direction.

20. The apparatus of claim 17, wherein each of the bars has a peaked side, the bar being positioned such that at least part of the peaked side of adjacent bars is in contact with the objects as the objects are moved along the grading mechanism.

21. The apparatus of claim 20, wherein each of the bars has a substantially flat side such that the bars have a generally triangular cross-section.

22. The apparatus of claim 17, further comprising an alignment mechanism positioned at one end of the bars and operative to deliver the objects to the bars such that adjacent bars support the objects.

23. The apparatus of claim 17, wherein the plurality of bars form a unitary bar assembly configured such that the displacement mechanism moves the bars together.

24. The apparatus of claim 9, wherein a linkage connects the counterbalance mechanism to the bar assembly, the linkage operative to allow the counterbalance mechanism and the bar assembly to move relative to each other in the first and second substantially horizontal directions.

25. The apparatus of claim 24, wherein the linkage includes a first member rotatably connected to the bar assembly, and a second member rotatably connected to the first member and to the counterbalance mechanism.

26. The apparatus of claim 9, further comprising a dampening mechanism disposed between the base and the counterbalance mechanism and operative to dampen movement of the counterbalance mechanism with respect to the base.

27. The apparatus of claim 26, wherein the a dampening mechanism is positioned to dampen horizontal movement of the counterbalance mechanism with respect to the base.

* * * * *